US010569138B2

(12) United States Patent
Lob

(10) Patent No.: US 10,569,138 B2
(45) Date of Patent: Feb. 25, 2020

(54) ASCENDER DEVICE AND METHOD OF USE

(71) Applicant: Harken, Incorporated, Pewaukee, WI (US)

(72) Inventor: Charles J. Lob, Oconomowoc, WI (US)

(73) Assignee: Harken, Incorporated, Pewaukee, WI (US)

( * ) Notice: Subject to any disclaimer, the term of this patent is extended or adjusted under 35 U.S.C. 154(b) by 89 days.

(21) Appl. No.: 15/788,298

(22) Filed: Oct. 19, 2017

(65) Prior Publication Data

US 2018/0104544 A1 Apr. 19, 2018

Related U.S. Application Data

(60) Provisional application No. 62/410,017, filed on Oct. 19, 2016.

(51) Int. Cl.
*A63B 29/02* (2006.01)

(52) U.S. Cl.
CPC ..... *A63B 29/02* (2013.01)

(58) Field of Classification Search
CPC ..... A63B 29/02; B66D 3/04; F16C 13/006; B63H 9/10
See application file for complete search history.

(56) References Cited

U.S. PATENT DOCUMENTS

D938,905 11/1909 Speerstra
1,505,360 A * 8/1924 Alva ..... A63B 29/02 182/134
1,982,482 A * 11/1934 Rhodes ..... E21B 19/10 188/67
3,724,593 A * 4/1973 O'Keefe ..... A63B 29/02 182/134
3,730,129 A * 5/1973 Helms ..... B63B 21/08 114/218
3,795,218 A * 3/1974 Merry ..... B63B 21/08 114/218

(Continued)

FOREIGN PATENT DOCUMENTS

EP 2103329 9/2009
FR 2597760 10/1987

(Continued)

*Primary Examiner* — Katherine W Mitchell
*Assistant Examiner* — Candace L Bradford
(74) *Attorney, Agent, or Firm* — James A. Joyce; Godfrey & Kahn, S.C.

(57) ABSTRACT

An ascender device is disclosed that includes a base plate having a base top, a base bottom, a base rear surface, and a base front surface, wherein the base front surface further includes a first side and a second side; a plurality of pawls that are rotationally biased and secured to the base plate, a plurality of teeth on the plurality of pawls, wherein at least in part, the teeth are opposed to each other to form a gap that extends between the teeth and wherein the gap is configured to receive a rope therein and can be increased and decreased in size via pivoting of the pawls to releasably engage the rope, a plurality of strap supports extending from the base, an upper gate adjacent the base top and having an opening for receiving the rope therein, and a securing mechanism for securement to an article of footwear.

19 Claims, 20 Drawing Sheets

(56) References Cited

U.S. PATENT DOCUMENTS

| | | | | | |
|---|---|---|---|---|---|
| 4,084,532 | A * | 4/1978 | Feder | B63B 21/08 | 114/218 |
| 4,276,958 | A * | 7/1981 | Skaalen | E06C 1/56 | 182/135 |
| 4,899,423 | A * | 2/1990 | Randall | A43C 3/04 | 114/218 |
| 5,360,083 | A * | 11/1994 | Hede | A62B 1/14 | 182/5 |
| 5,664,640 | A | 9/1997 | Smith | | |
| 5,794,272 | A | 8/1998 | Workman et al. | | |
| D408,714 | S * | 4/1999 | Pennoyer, Jr. | D8/349 | |
| 6,286,625 | B1 * | 9/2001 | Astvasadoorian | A63B 27/02 | 182/134 |
| 6,857,381 | B2 * | 2/2005 | Siewert | F16G 11/106 | 114/218 |
| 8,459,411 | B2 | 6/2013 | Maurice et al. | | |
| 10,093,393 | B2 * | 10/2018 | Yates | B63B 21/08 | |

FOREIGN PATENT DOCUMENTS

| | | | | |
|---|---|---|---|---|
| FR | 2597760 | A1 * | 10/1987 | A63B 29/02 |
| FR | 2790968 | | 9/2000 | |
| WO | WO2016174633 | | 11/2016 | |
| WO | WO-2018112518 | A1 * | 6/2018 | A62B 1/20 |

* cited by examiner

ASCENDER DEVICE AND METHOD OF USE

FIELD

The ascender device and method of use relate to the field of rope climbing.

BACKGROUND

Various circumstances may require a person to utilize a rope for climbing, such as ascending a tree to cut a branch. Generally, ascending a rope can be very difficult without the assistance of a locking device to temporarily support the person at various climbing points on the rope, particularly when the ascension is to great heights or requires the person to be suspended for an extended period of time. Existing ascender devices used for such purposes, such as the one disclosed in U.S. Pat. No. 8,459,411 to Maurice et al., the disclosure of which is incorporated herein by reference for all purposes, while somewhat effective also tend to cause excessive rope wear and a single device cannot be used on both left and right feet of the operator. Further, existing ascender devices commonly utilize a rope feed path that is not aligned with the anchoring reaction forces generated by the strapping configuration, such that when utilized during a climb, the device becomes racked at an angle, thus limiting the ability of the rope to feed properly therethrough and creating notable discomfort to the climber.

BRIEF DESCRIPTION OF THE DRAWINGS

Embodiments of the ascender device and method of use are disclosed with reference to the accompanying drawings and are for illustrative purposes only. The device and method of use are not limited in their application to the details of construction or the arrangement of the components illustrated in the drawings. The ascender device and method of use are capable of other embodiments or of being practiced or carried out in other various ways. In the drawings.

BRIEF SUMMARY

Figure 1:
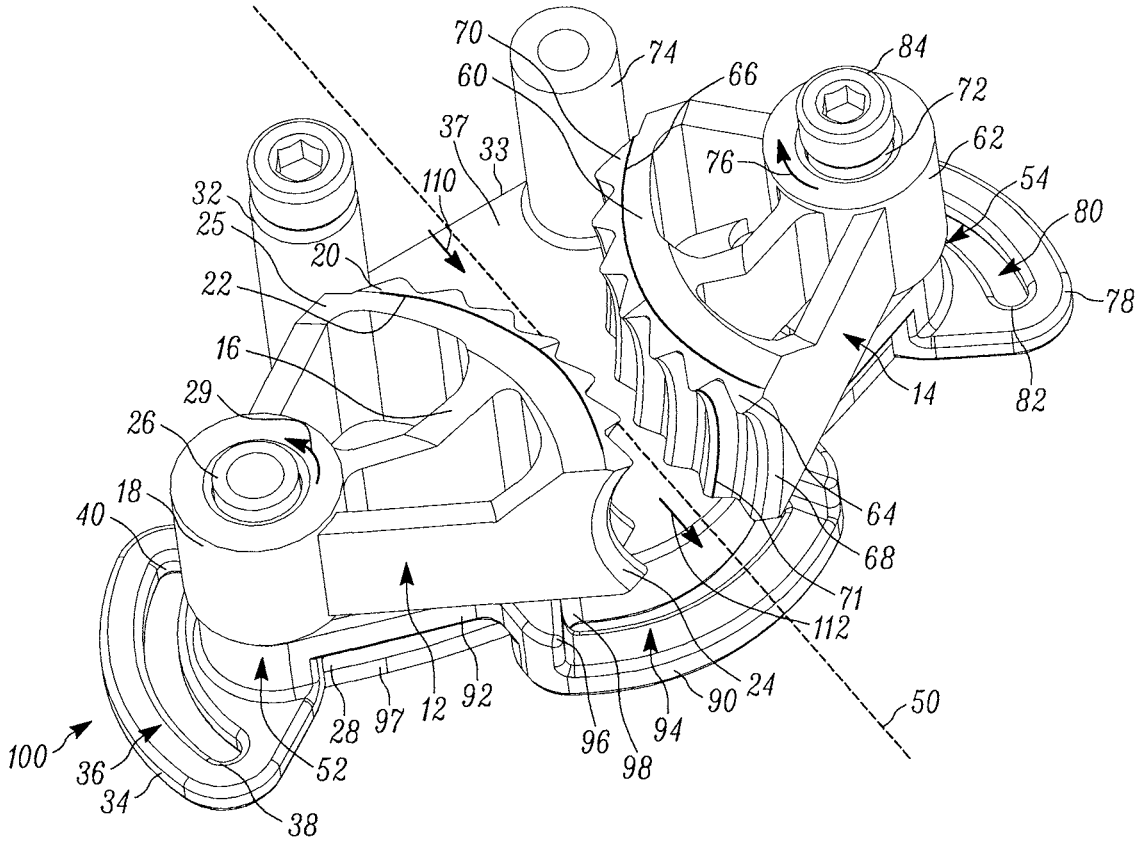
FIG. 1 illustrates a front perspective view of an exemplary embodiment of a ascender device.

In at least some embodiments, the ascender device relates to a device that includes a base having a first side and a second side and a base top; a first pawl including a pawl arm with a pawl engagement portion, wherein the first pawl is pivotably secured to the base on the first side; a second pawl including a pawl arm with a pawl engagement portion, and wherein the second pawl is pivotably secured to the base on the second side; a plurality of teeth situated along the curved first pawl engagement portion; a plurality of teeth situated along the curved second pawl engagement portion, wherein a dynamic gap is maintained between the teeth; a first strap support having a first strap support slot; a second strap support having a second strap support slot; a side strap interconnected with the first strap support slot and the second strap support slot; a third strap support having a third strap slot; a bottom strap interconnected with the side strap and the third strap slot; wherein the side strap and bottom strap are configured for securement to a object of a user; a first biasing element pivotably biasing the first pawl upwards towards the base top; and a second biasing element pivotably biasing the second pawl upwards towards the base top. The ends of the side strap may be connected to each other at the base or may only connect to the base. Similarly, bottom strap may be connected to the side strap at the base or may be connected only to the base.

In at least some other embodiments, disclosed is an exemplary embodiment of an ascender device configured to secure to an object and to receive and engage a rope, the device including: a base plate having a base top, a base bottom, a base rear surface and a base front surface, wherein the base front surface further includes a first side and a second side; a first pawl having a first pawl engagement portion, wherein the first pawl is pivotably secured to the base plate on the first side; a second pawl having a second pawl engagement portion, wherein the second pawl is pivotably secured to the base plate on the second side; a first biasing element pivotably biasing the first pawl in a counter-clockwise direction towards the base top; a second biasing element pivotably biasing the second pawl in a clockwise direction towards the base top; a plurality of first teeth situated along the first pawl engagement portion and second teeth situated along the second pawl engagement portion, wherein the first and second teeth are at least in part, opposed to each other to form a gap that extends between the teeth and the gap is configured to receive a rope therein; a plurality of upper strap supports extending from the base, including a first upper strap support situated on the first side and a second upper strap support situated on the second side; a plurality of lower strap supports extending from the base, including a first lower strap support situated on the first side and a second lower strap support situated on the second side; an upper gate extending from the base top having an opening for receiving the rope therein; a plurality of lower gates extending from the base bottom to receive the rope therebetween; and a securing mechanism for securement to an object, having a side strap interconnected with the first upper strap support and the second upper strap support, and a bottom strap, with the bottom strap including a bridled portion that couples a first bottom strap leg and a second bottom strap leg, which are secured to respective lower strap supports.

In at least yet some other embodiments, disclosed is an exemplary embodiment of an ascender device configured for securement to an article of footwear for engagement with a rope, that includes: a base plate having a base top, a base bottom, a base rear surface, and a base front surface, wherein the base front surface further includes a first side and a second side; a first pawl pivotably secured to the base plate on the first side; a second pawl pivotably secured to the base plate on the second side; at least one biasing element for pivotably biasing the first pawl counter-clockwise towards the base top and the second pawl clockwise towards the base top; a plurality of first teeth on the first pawl and second teeth on the second pawl, wherein the first and second teeth are at least in part, opposed to each other to form a gap that extends between the teeth and wherein the gap is configured to receive a rope therein and can be increased and decreased in size via pivoting of the first and second pawls to releasably engage the rope; a plurality of upper strap supports extending from the base; a plurality of lower strap supports extending from the base; an upper gate adjacent the base top and having an opening for receiving the rope therein; a plurality of lower gates extending from the base bottom to receive the rope; and a securing mechanism for securement to an article of footwear, having a side strap interconnected with the plurality of upper strap supports, and a bottom strap interconnected with the plurality of lower strap supports, and wherein a first central vertical axis defined by the upper gate, plurality of lower gates base plate and the gap provides a substantially straight rope feed-through path for receiving the rope therethrough and wherein the rope feed-through path maintains the rope in a substantially vertical position as it extends above and below the base plate.

In at least some further other embodiments, disclosed is an exemplary embodiment of an ascender climbing device configured for securement to an article of footwear for engagement and disengagement with a rope during climbing, that includes: a base plate having a base top, a base bottom, a base rear surface, and a base front surface, wherein the base front surface further includes a first side and a second side; a first pawl having a first pawl engagement portion, wherein the first pawl is pivotably secured to the base plate on the first side; a second pawl having a second pawl engagement portion, wherein the second pawl is pivotably secured to the base plate on the second side; at least one biasing element for pivotably biasing the first pawl counter-clockwise towards the base top and the second pawl clockwise towards the base top; wherein the first pawl engagement portion and second pawl engagement portion are at least in part, opposed to each other to form a gap that extends therebetween, and wherein the gap is configured to receive a rope therein and the gap can be increased and decreased in size via pivoting of the first and second pawls to releasably engage the rope; a first strap support extending from the base and a second strap support extending from the base opposite the first strap support; a third strap support extending from the base bottom; a gate adjacent the base top and having an opening for receiving the rope; and a securing mechanism for securement of the base to an article of footwear, the securing mechanism having a side strap interconnected with the first and second strap supports, and a bottom strap interconnected with the third strap support, and wherein a first central vertical axis defined by the gate and the gap between the first pawl and the second pawl provides a substantially straight rope feed-through path for receiving the rope therethrough.

Other embodiments, aspects, and features of the device and method will be understood and appreciated upon a full reading of the detailed description and the claims that follow.

DETAILED DESCRIPTION

Referring to FIG. 1, an exemplary ascender device 100 is illustrated. The device 100 includes a plurality of pawls, such as a first pawl 12 and a second pawl 14. First pawl 12 includes a first pawl arm 16 that extends radially from a first pawl sleeve 18. The first pawl arm 16 is secured to or otherwise integrally formed with first pawl sleeve 18. In at least some embodiments, first pawl arm 16 includes a plurality of teeth 20 situated along a first pawl engagement portion 22. The first pawl engagement portion 22 extends between a first outlet edge 24 and a first inlet edge 25.

The first pawl sleeve 18 is pivotably secured to a first post 26, which extends from a base plate 28, wherein base plate 28 includes a base rear surface 27 (see FIG. 2) and a base front surface 37. Although not required, in at least some embodiments, situated between first pawl sleeve 18 and first post 26 is a first post bearing, which can provide low resistance pivoting of first pawl 12 relative to base plate 28. In addition, one or more biasing elements, such as a spring 43 (see FIG. 8) is affixed to base rear surface 27, and interconnected to first pawl 12 and second pawl 14 to bias them upwards toward a base top 33 of base plate 28. More particularly, first pawl 12 is biased to pivot first pawl arm 16 relative to first post 26 directionally as shown by a first pivot arrow 29, and second pawl 14 is biased to pivot second pawl arm 60 relative to second post 72 directionally as shown by a second pivot arrow 76.

Figure 5:
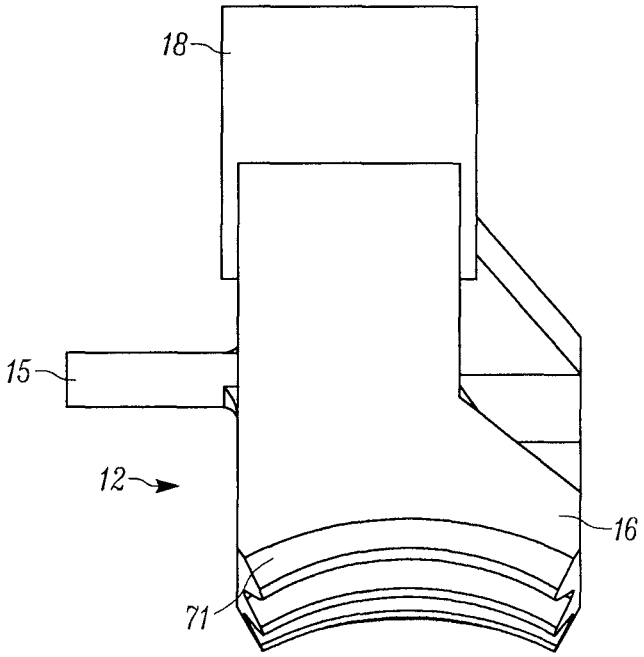
FIG. 5 illustrates an exemplary first pawl of the device of FIG. 3.
Figure 6:
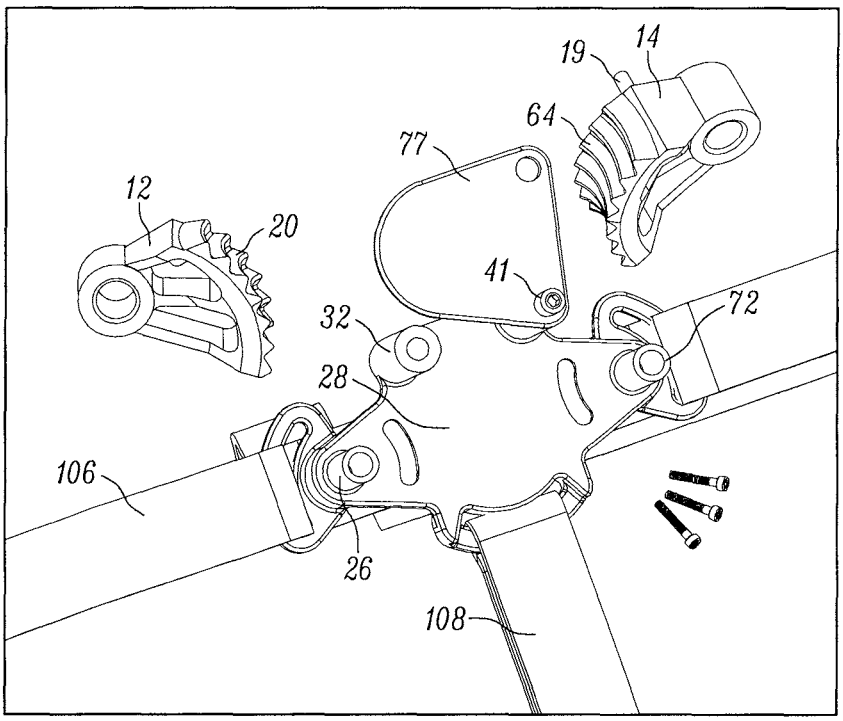
FIG. 6 illustrates a partially disassembled view of various components of the device of FIG. 3.
Figure 7:
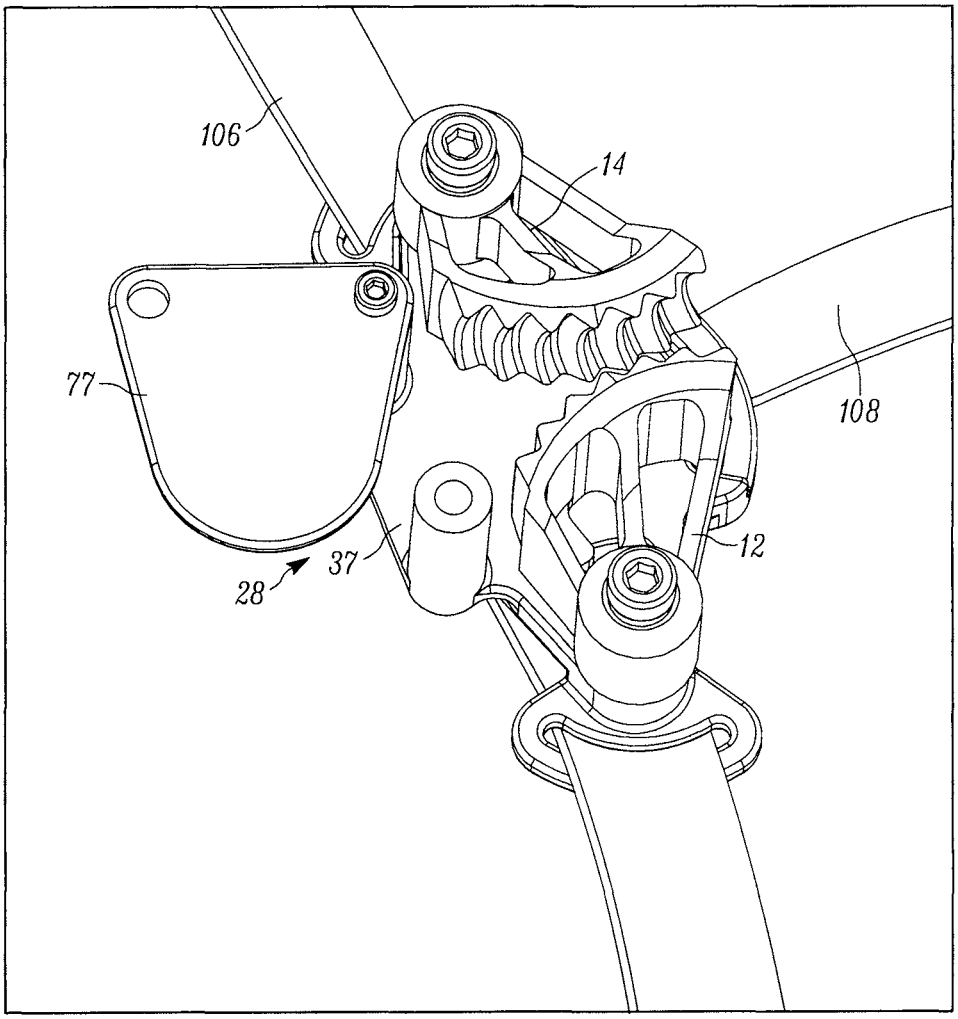
FIG. 7 illustrates a view of the device as shown in FIG. 6 with the pawls installed.
Figure 8:
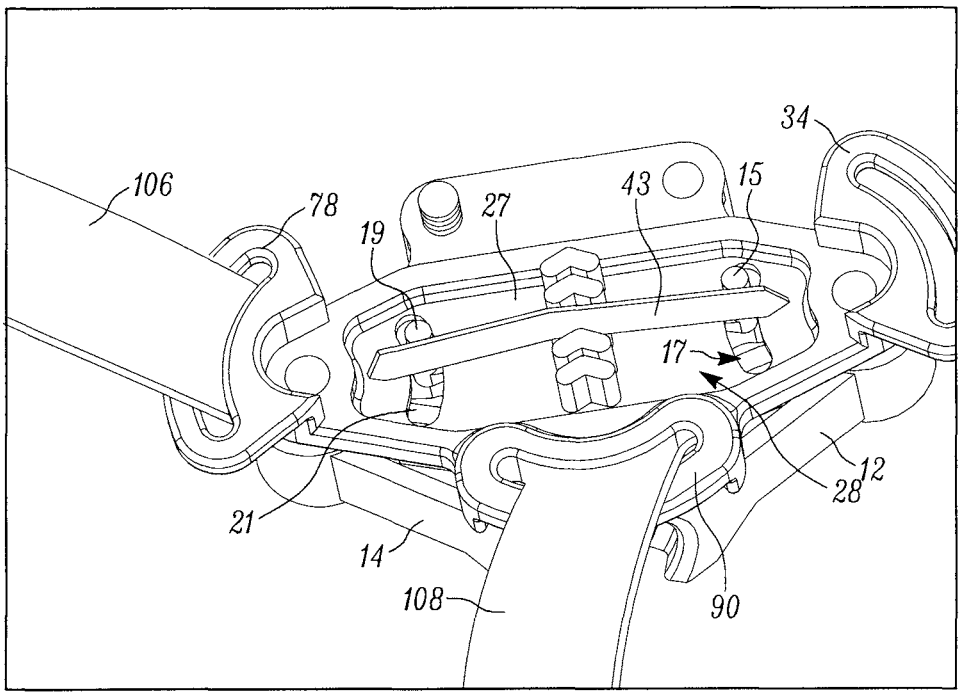
FIG. 8 illustrates another rear perspective view of the device of FIG. 3, with a rear cover plate removed.

In at least some embodiments, the one or more biasing elements can include multiple springs secured in various other manners to pawls 12 and 14 to provide the resultant pivot bias. Further, as shown in FIG. 8 and in at least some embodiments, first pawl 12 includes a bias post 15 (FIG. 5) that extends through first bias slot 17 in base plate 28, where bias post 15 engages a spring 43 (or other bias element). Similarly, in at least some embodiments, second pawl 14 includes a bias post 19 that extends through second bias slot 21 in base plate 28, where bias post 19 engages spring 43 (or another bias element).

A first strap support 34 is secured to or otherwise integrally formed with base plate 28 and extends outward relative to first post 26. The first strap support 34 includes a first strap slot 36, which in some embodiments is curved as it extends between a first slot first end 38 and a first slot second end 40. Additionally, a first fastener 41 (see FIG. 3) is provided to secure first pawl 12 to first post 26.

The device 100 is in at least some embodiments, symmetrical relative to a central vertical axis 50, wherein such symmetry can be substantial or partial. As shown in the exemplary embodiment illustrated in FIG. 1, device 100 is symmetrical relative to central vertical axis 50 and therefore, for descriptive purposes herein and not to be interpreted as limiting, device 100 includes a first side 52 and a second side 54. The first side 52 includes various elements, all or most of which have been described in whole or in part above. As shown in FIG. 1, second side 54 includes similar components to first side 52, such as second pawl 14, and as such has been described below with the same detail. More particularly, second pawl 14 includes a second pawl arm 60 that extends radially from a second pawl sleeve 62, wherein second pawl arm 60 includes a plurality of teeth 64 situated along a second pawl engagement portion 66. In at least some embodiments, second pawl engagement portion 66 extends between a second outlet edge 68 and a second inlet edge 70. The pluralities of teeth 20 and 64 include an edge, such as exemplary edge 71 that extends from the end of the pawl arms about pawl engagement portions 22 and 66, respectively. In at least some embodiments, edge 71 is curved (i.e., arced) to accommodate the cylindrical shape of rope 10, which can serve to limit damage to rope 10 when pinched between teeth 20 and 64, and to help contain rope 10 in the pawls when no force is exerted on the device 100 and the pawls are not engaged (e.g., the climber lifts the shoe) while in other embodiments, the edge 71 can be straight or another shape.

Referring to FIGS. 3-7 and 10, second pawl sleeve 62 is pivotably secured to a second post 72, which extends from base plate 28. Although not necessary, in at least some embodiments, situated between second pawl sleeve 62 and second post 72 is a second post bearing, which can provide low resistance pivoting of second pawl 14 relative to base plate 28. Gate 77 is fastened to first post 26 and second post 72 to assist with guiding rope 10 between guide posts and the pawls, and to cover the opening opposite base front surface 37 and secure rope 10 therebetween. Gate 77 is releasably secured to at least one of the posts such that it is pivotable between an open position and a closed positon wherein in the open position device 100 can be attached to rope 10 anywhere along its length rather than feeding rope 10 into device 100. Any appropriate mechanism can be used to releasably secure gate 77 in the closed position, e.g., pins, spring locks, etc., but it is preferable that the mechanism be operable by one hand so as to facilitate movement from the closed to the open position while in use.

A second strap support 78 is secured to or otherwise integrally formed with base plate 28 and extends outward relative to second post 72. The second strap support 78 includes a second strap slot 80, which in some embodiments is curved as it extends between a second slot first end 82 and a second slot second end 83 (see FIG. 2). Additionally, a second fastener 84 is provided to secure second pawl 14 to second post 72. The device 100 further includes a third strap support 90 secured to or otherwise integrally formed with base plate 28 and extends from a base bottom 92. The third strap support 90 includes a third strap slot 94, which in some embodiments is curved as it extends between a third slot first end 96 and a third slot second end 98.

Figure 2:
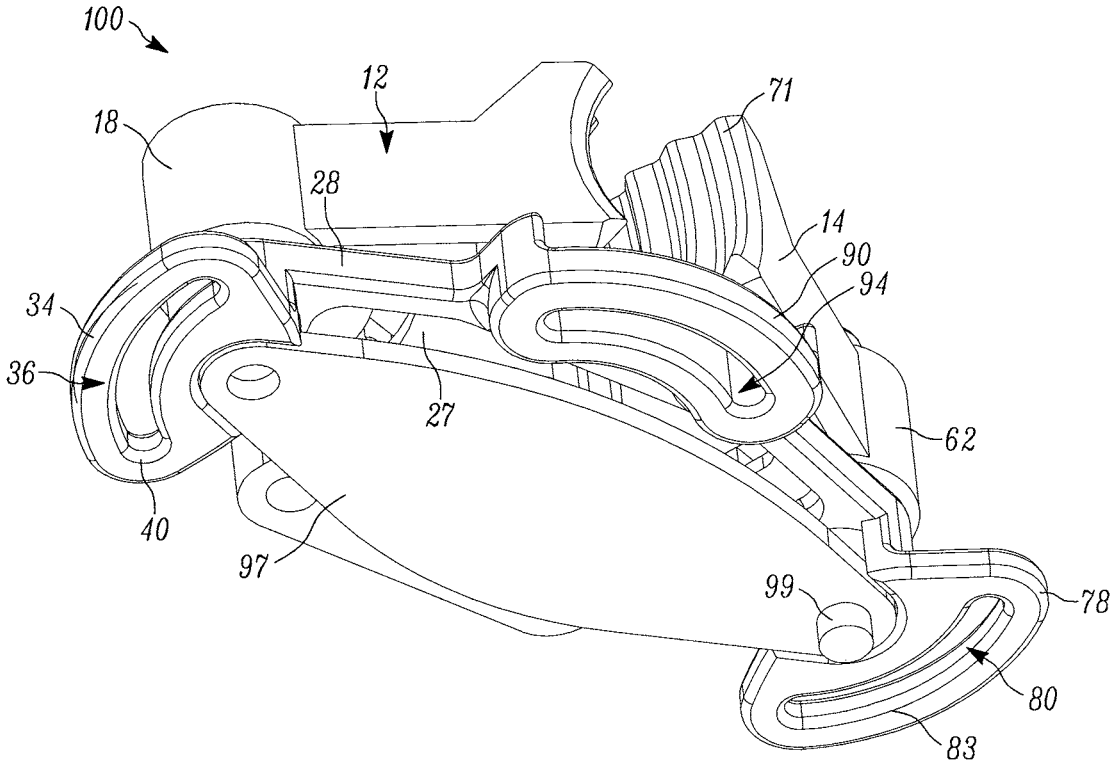
FIG. 2 illustrates a rear perspective view of the device of FIG. 1.
Figure 3:
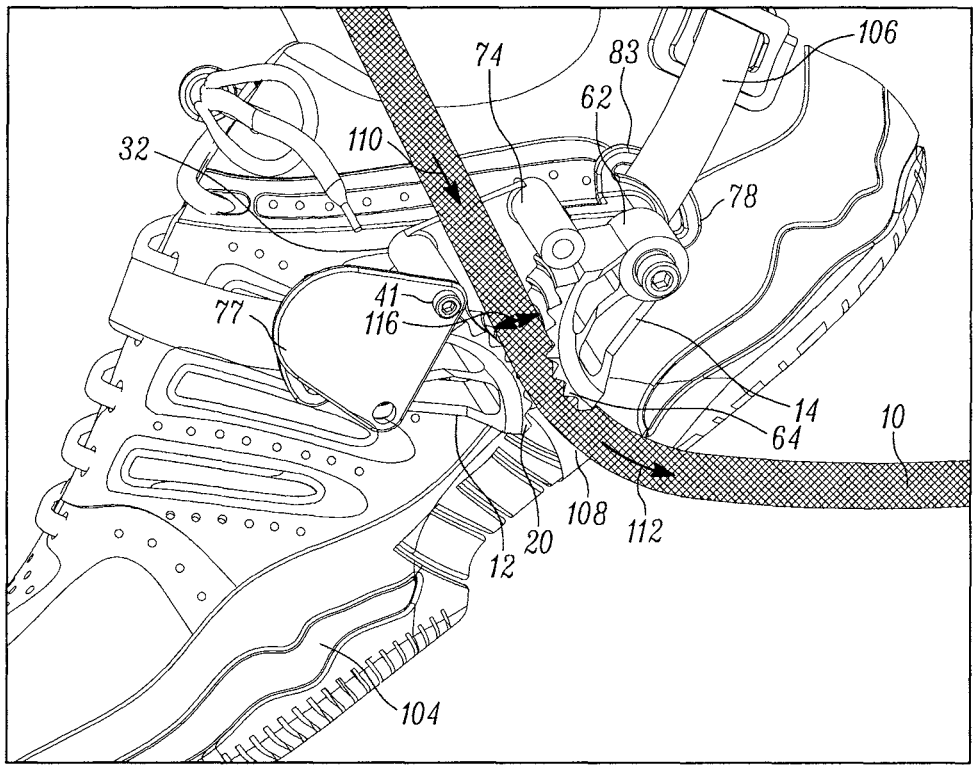
FIG. 3 illustrates the device of FIG. 1 with straps installed, secured to an object, and in communication with a rope.
Figure 4:
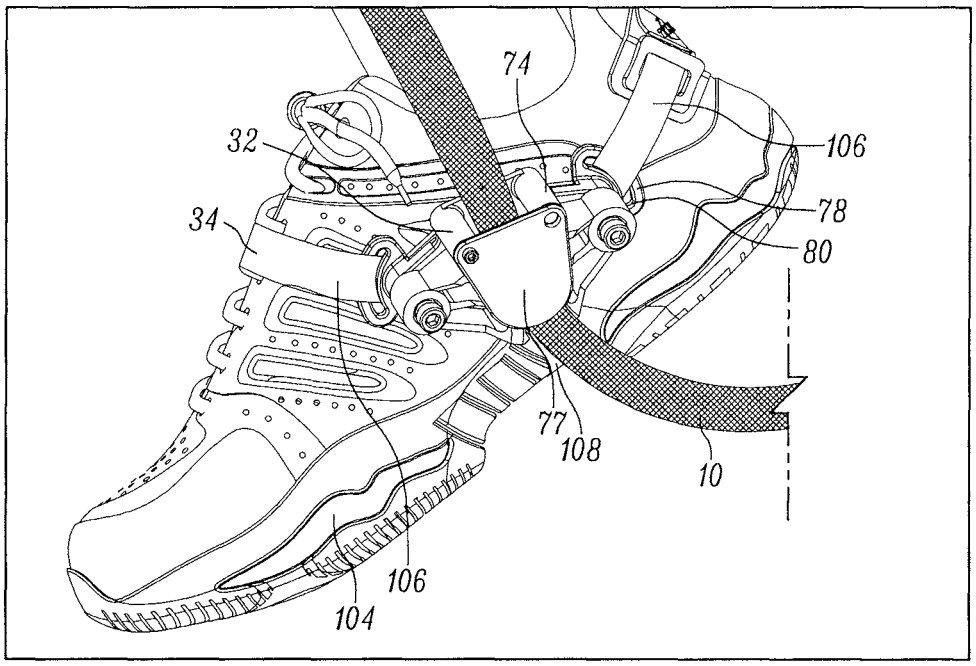
FIG. 4 illustrates another view of the device as shown in FIG. 3 with a gate positioned over the rope.
Figure 9:
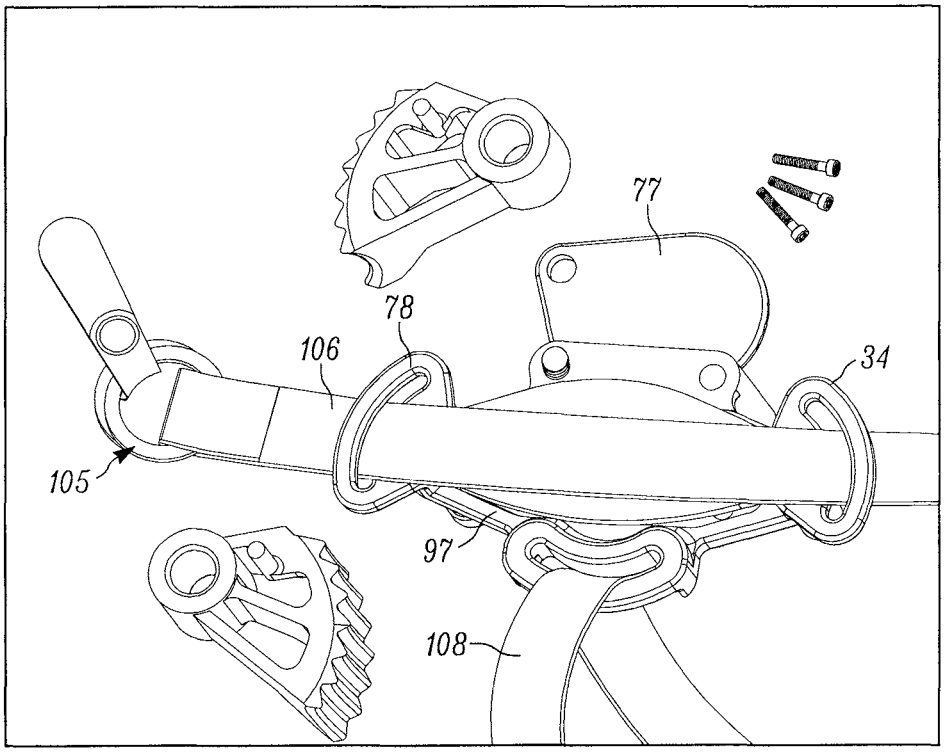
FIG. 9 illustrates the device as shown in FIG. 7, but with the pawls not installed.
Figure 10:
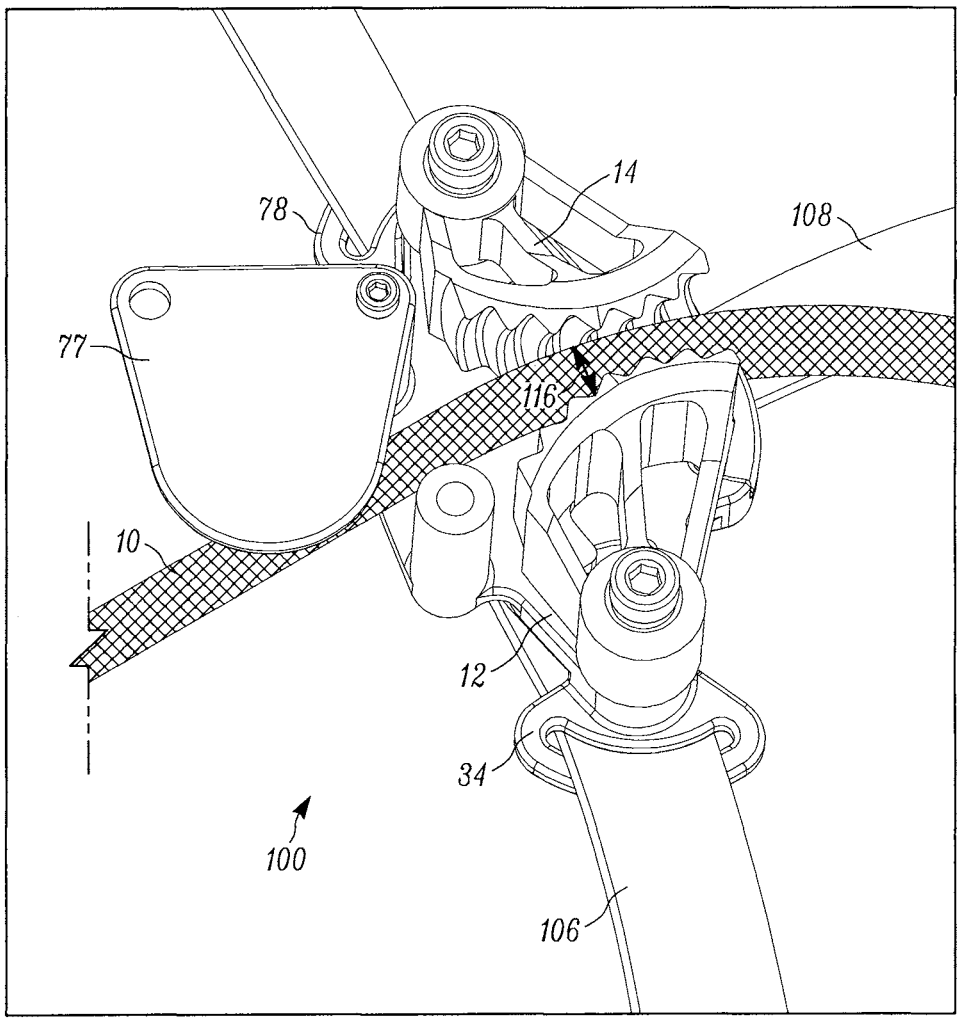
FIG. 10 illustrates the device of FIG. 3 in communication with a rope.

Referring at least to FIGS. 2 and 9, a bottom perspective of device 100 is provided that shows a rear cover plate 97. The rear cover plate 97 is secured to base plate 28 via a plurality of fasteners, such as a bolt 99. Referring at least to FIGS. 3 and 4, a top perspective view illustrates device 100 secured to a shoe 104 by a securement device and in communication with rope 10. While a shoe 104 is shown and referenced throughout for simplicity, it is merely exemplary for other objects and therefore is not to be considered limiting, and as such, it is to be understood that the device 100, and subsequent devices 200, and 300, can be secured to any one of various objects other than a shoe, including other articles of footwear worn by a user/climber (e.g., a boot), a package, a person, an animal, etc.

The securement device is comprised of a side strap 106 and a bottom strap 108. The side strap 106 and bottom strap 108 can be comprised of any one of various materials suitable for supporting sufficient weight of a user, such as a synthetic woven nylon material, etc. In at least some embodiments, side strap 106 is secured to first strap support 34 and to second strap support 78. Further, in at least some embodiments, the securement can be fixed or passive. In a fixed configuration, side strap 106 is secured at a first end to strap support 34 and at a second end to second strap support 78, wherein in a passive securement, side strap 106 passes continuously through first strap slot 36 and second strap slot 80 and is allowed to move relative thereto. Side strap 106 includes one or more re-securable connections, such as adjustable strap connector 105, which allows device 100 to be repeatedly securely installed and removed from shoe 104. Alternatively, device 100 can be permanently secured to shoe 104 or otherwise utilize various other securing mechanisms to secure to shoe 104. In at least some embodiments, side strap 106 can be comprised of two separate straps, each connecting respectively to one of strap supports 34 and 78. As is conventional (see., e.g., FIGS. 1 and 5 of U.S. Pat. No. 8,459,411 to Maurice et al.), bottom strap 108 is secured to or looped through third strap slot 94 and secured to side strap 106 either directly or via a secured or securable connection on the opposite side of shoe 104. In an alternative embodiment, bottom strap 108 may also be secured to side strap 106 at or near device 100. Bottom strap 108 provides vertical support for device 100, and side strap 106 provides lateral support to keep device 100 in place relative to shoe 104.

As noted above, first strap support 34 includes first strap slot 36, which in some embodiments is curved as it extends between first slot first end 38 and first slot second end 40. Similarly, second strap support 78 includes second strap slot 80, which in some embodiments is curved as it extends between second slot first end 82 and second slot second end 83. Such a configuration provides for ambidextrous mounting of device 100, in that it can be secured on either the inside of a climber's left shoe or right shoe. This provides a substantial advantage over prior art, as a single device can be manufactured and sold, as opposed to two distinct devices that are left or right specific.

Once device 100 is secured to shoe 104, device 100 can be utilized to engage and securably interface with rope 10 to support a climber during ascension of rope 10. In one embodiment, gate 77 is releasably secured to at least one of the posts such that it is pivotable between an open position and a closed positon wherein in the open position device 100 can be attached to rope 10 anywhere along its length by pivoting open the first pawl 12 and second pawl 14. Alternatively, to engage rope 10 with device 100 when gate 77 is in a closed position, rope 10 can be fed into device 100 via rope feed inlet portion 110 and out via rope feed outlet portion 112. More particularly, rope 10 can be passed between first guide post 32 and second guide post 74, which serve to provide alignment and smooth passage of rope 10, even at an angle. In at least some embodiments, first guide post 32 and second guide post 74 are generally cylindrical. Rope 10 is further passed in-between first pawl 12 and second pawl 14. As rope 10 engages teeth 20 and teeth 64, first pawl 12 pivots downward (away from guide posts) via pivotable connection between first pawl sleeve 18 and first post 26, and similarly, second pawl 14 pivots downward (away from guide posts) via the pivotable connection between second pawl sleeve 62 and second post 72. As first pawl 12 and second pawl 14 pivot downwards, the curved first pawl engagement portion 22 and second pawl engagement portion 66 position teeth 20 and teeth 64 to allow rope 10 to pass inside gap 116 (see FIG. 3) situated therebetween. In this manner, rope 10 can be fed continuously and/or repeatedly through rope feed inlet portion 110 and via rope feed outlet portion 112.

After rope 10 has been positioned in device 100, the climber pushes shoe 104 downward to ascend, which causes first pawl 12 to pivot in a reverse direction, opposite to first pivot arrow 29, and second pawl 14 to pivot in a reverse direction, opposite to second pivot arrow 76. This results in a narrowing of gap 116, thereby pinching rope 10 between teeth 20 and teeth 64. As the weight of the climber bears down against rope 10, first pawl 12 and second pawl 14 continue to impart an increased gripping force on rope 10, allowing the climber to support himself on the rope 10. When the climber wishes to continue ascension, the shoe 104 is lifted to relieve the downward force on first pawl 12 and second pawl 14, allowing the pawls to pivot downward again, increasing the size of the gap 116, and allowing rope 10 to move downward via rope feed outlet portion 112. This process is repeated as the climber ascends.

Figure 11:
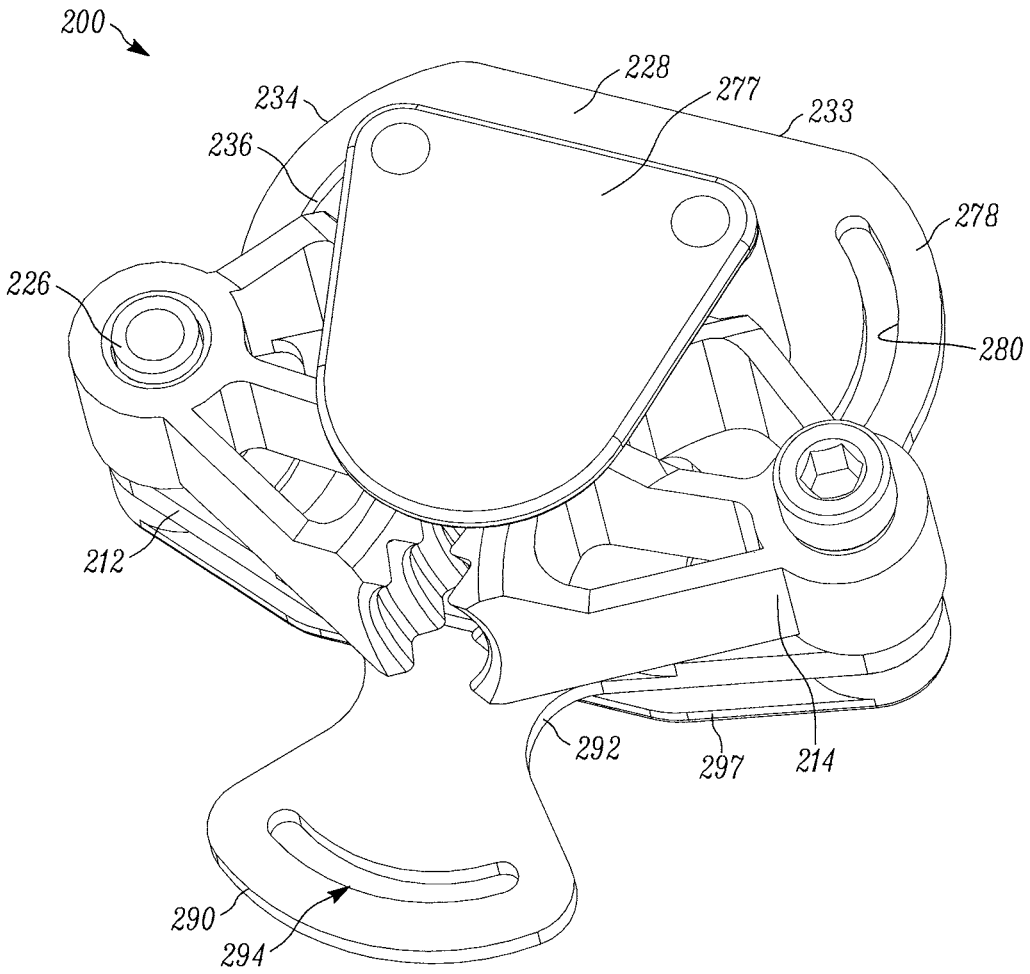
FIG. 11 illustrates a front perspective view of another embodiment of an exemplary ascender device.
Figure 12:
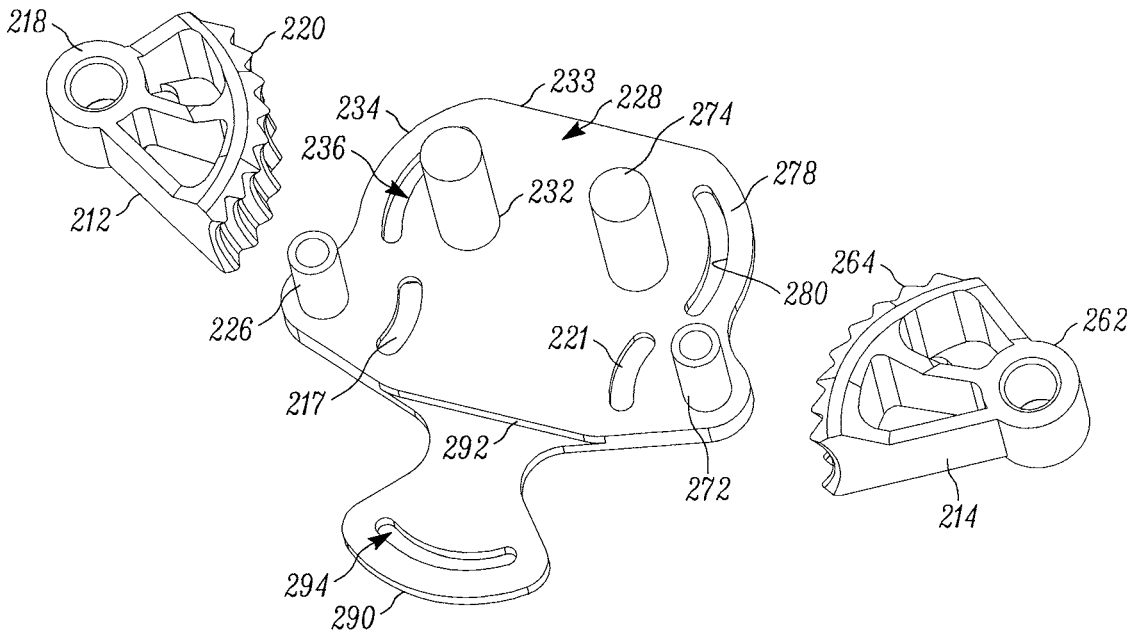
FIG. 12 illustrates an exploded front perspective view of the device of FIG. 11.
Figure 13:
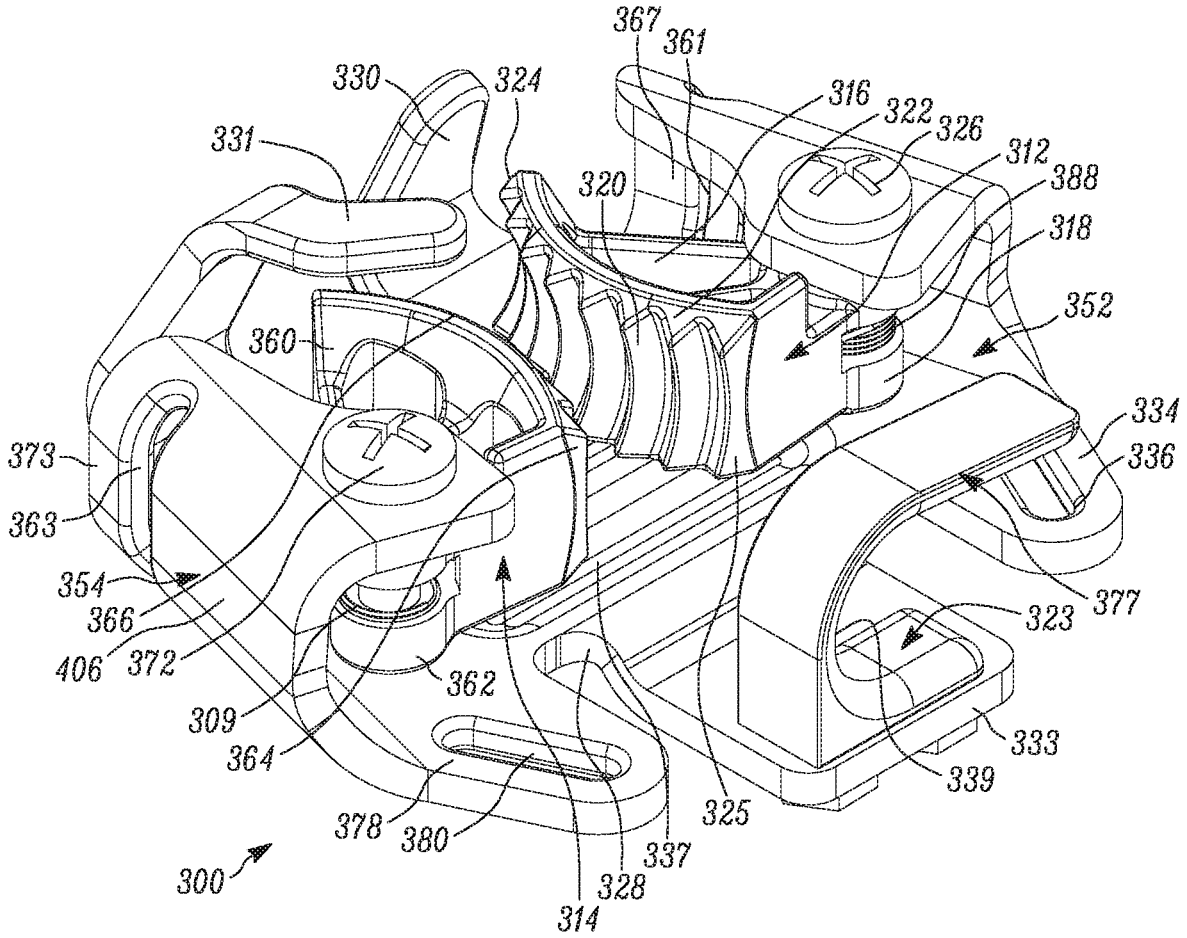
FIG. 13 illustrates a front perspective view of yet another exemplary embodiment of a ascender device.
Figure 14:
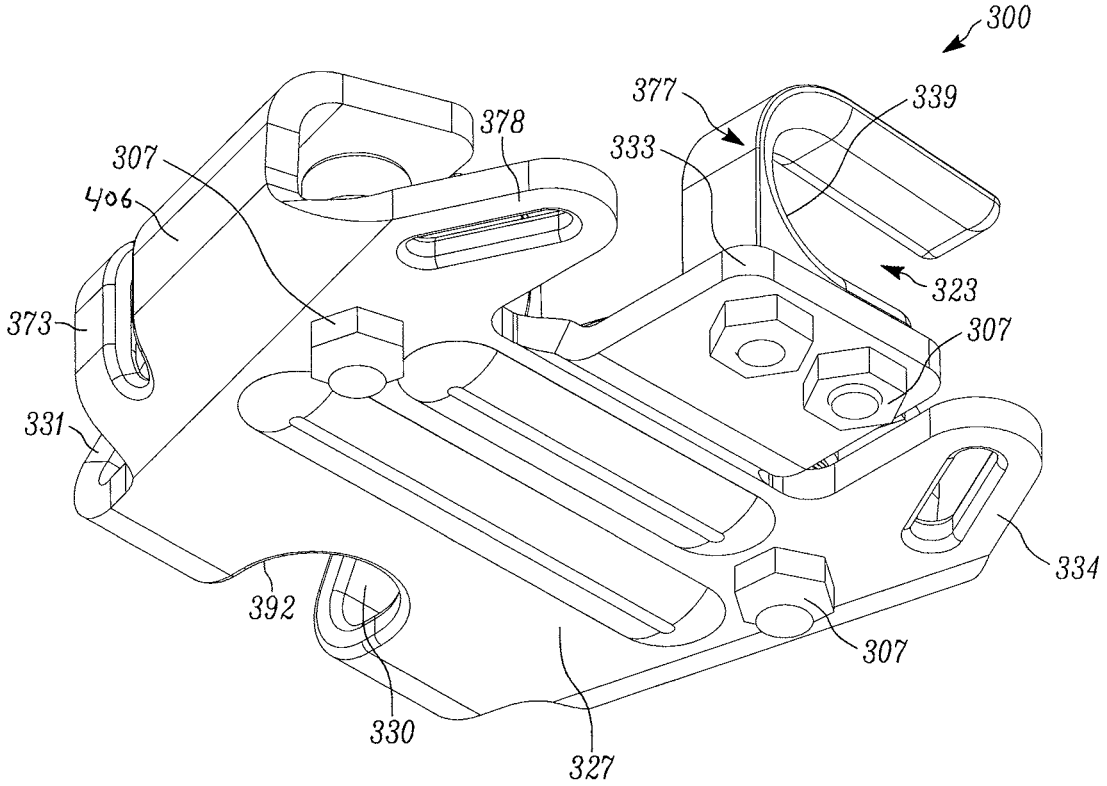
FIG. 14 illustrates a rear perspective view of the device of FIG. 13.
Figure 15:
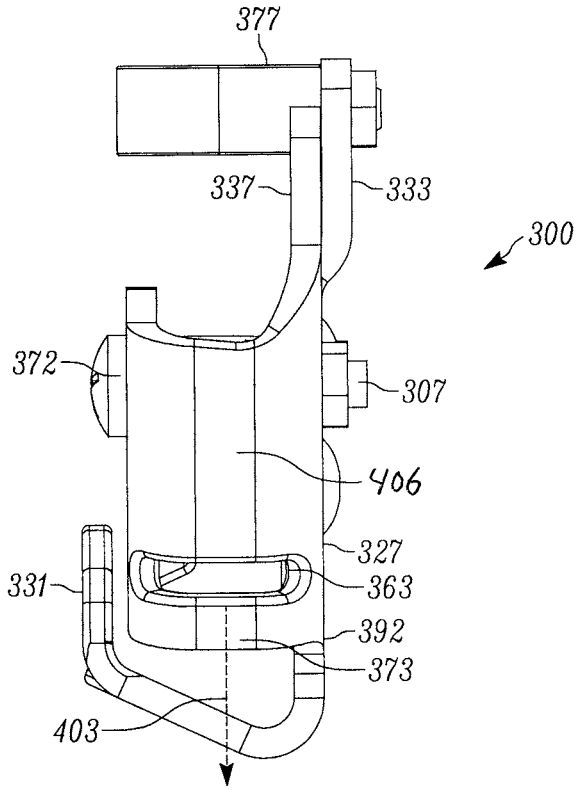
FIG. 15 illustrates a right side view of the device of FIG. 13.

Referring now to FIGS. 11 and 12, another exemplary embodiment of a ascender device 200 is illustrated. The device 200 is substantially similar in form and function to device 100, with the exception of a differently configured base plate 228, and therefore a complete description of components and their operation are not repeated herein with the understanding that similar components can differ in some manner without limitation. In addition, components for device 200 are labeled in FIGS. 11 and 12 using similar numbers to identify similar components (e.g., 12 and 212 are both understood to be first pawls, etc.).

The base plate 228 is similar to base plate 28 in function, although it has been modified to provide a different interface and interaction with a shoe during use. As can be seen in FIGS. 11 and 12, first strap support 234 and first strap slot 236 are positioned upwards on base plate 228, closer to base top 233 than as was described relative to device 100, and first strap support 234 is notably less pronounced as a sideways outward extension relative to first post 226. Similarly, second strap support 278 and second strap slot 280 are positioned upwards on base plate 228, closer to base top 233 than as was described relative to device 100, and second strap support 278 is notably less pronounced as a sideways outward extension relative to second post 272. Further, third strap support 290 and third strap slot 294 are positioned farther downwards on base plate 228 from base top 233 than as was described relative to device 100, and third strap support 290 extends further outward from base bottom 292. The spatial positioning of slots 236, 278, and 290 in an increased vertical manner can provide increased vertical stability when secured to shoe 104.

Referring now to FIGS. 13-24, yet another exemplary embodiment of a ascender device 300 is illustrated. The device 300 includes a first pawl 312 and a second pawl 314, wherein the first pawl and a second pawls 312, 314, are similar in form and function to pawls 12 and 14 of device 100, with the exception that they lack the bias posts extending therefrom. As such, first pawl 312 includes a first pawl arm 316 that extends radially from a first pawl sleeve 318. The first pawl arm 316 is secured to or otherwise integrally formed with first pawl sleeve 318 and includes a plurality of first teeth 320 situated along a first pawl engagement portion 322. The first pawl engagement portion 322 extends between a first outlet edge 324 and a first inlet edge 325. Similarly, a second pawl 314 includes a second pawl arm 360 that extends radially from a second pawl sleeve 362. The second pawl arm 360 is secured to or otherwise integrally formed with second pawl sleeve 362. The second pawl arm 360 includes a plurality of second teeth 364 situated along a second pawl engagement portion 366. The first and second pawl arms 316 and 360 can each include a plurality of radial portions extending to form the arms. Various features of first and second teeth 320 and 364, such as their shape and engagement surfaces are the same or substantially the same as discussed above with regard to pawl teeth 20 and 64 and therefore a complete description of each facet and their configuration is not repeated here with the understanding that similar components can differ in some manner without limitation. Additionally, during operation, the first and second teeth 320 and 364 engage with rope 10 similar to pawl teeth 20 and 64, as discussed above, to grip and release the rope accordingly during use. Further, with regard to various components shown and or described in the embodiments for the device 300 in light of the device 100, in many cases, such components may be labeled using similar numbers to identify similar components (e.g., 12 and 312 are both understood to be first pawls, etc.).

The device 300 includes a base plate 328 having a first side wall 332, a second side wall 406, a base rear surface 327 (see FIG. 14) and a base front surface 337. The first side wall 332 and second side wall 406 extending at least in part, perpendicular or otherwise non-planar relative to base front surface 337. The base front surface 337 further includes a first side 352 and a second side 354. The pawls 312 and 314 are pivotably secured to base plate 328 via a first post 326 (see FIG. 19) situated about first side 352 and a second post 372 situated about second side 354, respectively. The posts 326 and 372 extend through respective first and second pawl sleeves 318 and 362, and can be secured to base plate 328 using any of various types of fastener configurations, such as threads and mating nuts 307, welding, etc. The first and second pawls 312 and 314 are rotationally biased to rotate upwards (towards a base top 333 of base plate 328) to engage rope 10. In at least some embodiments, the rotational bias is provided by a first spring 388 and a second spring 309 which are situated respectively around first and second posts 326 and 372. The base plate 328 further includes an upper gate 377 integrally formed with or secured thereto. In at least some embodiments upper gate 377 is secured to base top 333. The upper gate 377 can take many forms, although in at least some embodiments, it has a hook or "J-shape" and can be fastened to base plate 328 using one or more fasteners, such as nuts 307. The upper gate 377 includes an opening 323 for receiving rope 10 therethrough, and a curved inner wall 339 to provide a smooth abutment to guide and/or contain rope 10. In at least some embodiments, the opening 323 of the upper gate is not closable by any included structure to prevent rope 100 from being removed along its length (i.e., the length of rope situated between terminal ends).

A plurality of bottom gates, such as a first bottom gate 330 and a second bottom gate 331 extend from a base bottom 392 situated opposite base top 333. In at least some embodiments, both bottom gates 330 and 331 are shaped and sized to be able to assist with guiding and/or containing rope 10 as it passes through pawls 312 and 314 and along base plate 328 and as such, can include various bent and curved portions, which in some embodiments extend at least partially over a gap 317 between first and second teeth 320 and 364 (see FIGS. 20 and 24). The combination of the upper and lower gates above and below the pawls 312 and 314 provide vertical guides for rope 10 to be easily passed through pawls 312 and 314 during ascension, yet still allow for the climber to easily disengage rope 10 from device 300 as desired. More particularly, as the upper and lower gates are not closed, they do not require an end of rope 10 to be fed into or out of device 300, with rope 10 therefore being engageable and disengageable at any point along its length and at any time during a climb. In at least some embodiments, at least one of the upper and lower gates can be releasably or permanently closed.

Referring now to FIGS. 17-24, device 300 further includes a securement device 365 comprising of one or more portions configured to secure device 300 to a shoe 304 (or other object as noted above with regard to shoe 104). In at least some embodiments, securement device 365 includes one or more strap portions that allow device 300 to repeatedly be securely installed and removed from shoe 304. For example, a side strap 306 and a bottom strap 308, which can include a plurality of integrated, interlocking, or otherwise engaged portions that provide adjustable retention of device 300 to shoe 304 via one or more adjusters/connectors 305, such as a buckle, VELCRO, etc. Such a configuration is similar to the straps 106 and 108 discussed above, with the exception that the bottom strap 308 includes a bridled portion 345 having a first bottom strap leg 346 and a second bottom strap leg 347. In addition, wherein device 300 is secured to objects other than a shoe, securement device 365 can be appropriately modified, such as by utilizing straps shaped and sized to secure the selected object type. Any one of or all of the straps discussed herein can include a ribbon-shape configuration having a opposite planar sides as shown, while in other embodiments, other shapes can be utilized, such as round, square, etc.

Base plate 328 further includes a plurality of strap supports positioned for engagement with securement device 365 in a manner that balances the forces experienced by device 300 with respect to shoe 304 during climbing. As shown and in at least some embodiments, device 300 includes first and second upper strap supports 334 and 378 positioned above or approximately above pawls 312 and 314 to provide securement to a shoe upper portion 348, wherein the first upper strap support 374 can include a first upper strap slot 336, and second upper strap support 378 can include a second upper strap slot 380. First and second lower strap supports 367 and 373 are also provided on base plate 328 to provide securement around a shoe lower portion 349, wherein first lower strap support 367 is positioned about the first side wall 332 and can include a first lower strap slot 361, and second lower strap support 373 is positioned about the second side wall 406 and can include a second lower strap slot 363.

In at least some embodiments, the securement of the straps can be fixed or passive. In a fixed configuration, side strap 306 is secured at a first end to first upper strap support 334 and at a second end to second upper strap support 378, wherein in a passive securement, side strap 306 passes continuously through first upper strap slot 336 and second upper strap slot 380 and is allowed to move relative thereto. In at least some embodiments, device 300 can be permanently secured to shoe 304 or otherwise utilize various other securing mechanisms to secure to shoe 304. In at least some embodiments, side strap 306 and bottom strap 308 can be comprised of any one of various materials suitable for supporting sufficient weight of a climber, such as a synthetic woven nylon material, etc. In at least some embodiments, straps 306 and 308 can be secured to base plate 328 via sewn, riveted, or clamped connections, and/or utilize an exemplary rigid hook attachment 375 secured at their ends to prevent chafing during use. In addition, in at least some embodiments, upper strap supports 334, 378 and/or lower strap supports 367, 373 can be provided without slots 336, 380, 361 and 363.

In at least some embodiments, bottom strap 308 is secured to base plate 328 via the bridled portion 345. More particularly, first bottom strap leg 346 can be secured to first lower strap support 367, such as via the first lower strap slot 361, and second bottom strap leg 347 can be secured to second strap support 373, such as via second lower strap slot 363. The first bottom strap leg 346 and second bottom strap leg 347 can be removably or permanently secured in the aforementioned manners. In at least some embodiments, and as shown in FIGS. 17-24, base plate 328 includes a tapered profile as it extends downward along first side wall 332 and second side wall 406, such that first bottom strap leg 346 and second bottom strap leg 347 naturally extend downward at angles relative to a central vertical axis 385 (FIG. 24) that extends through device 300 and follows the through-path of rope 10 during use.

Figure 24:
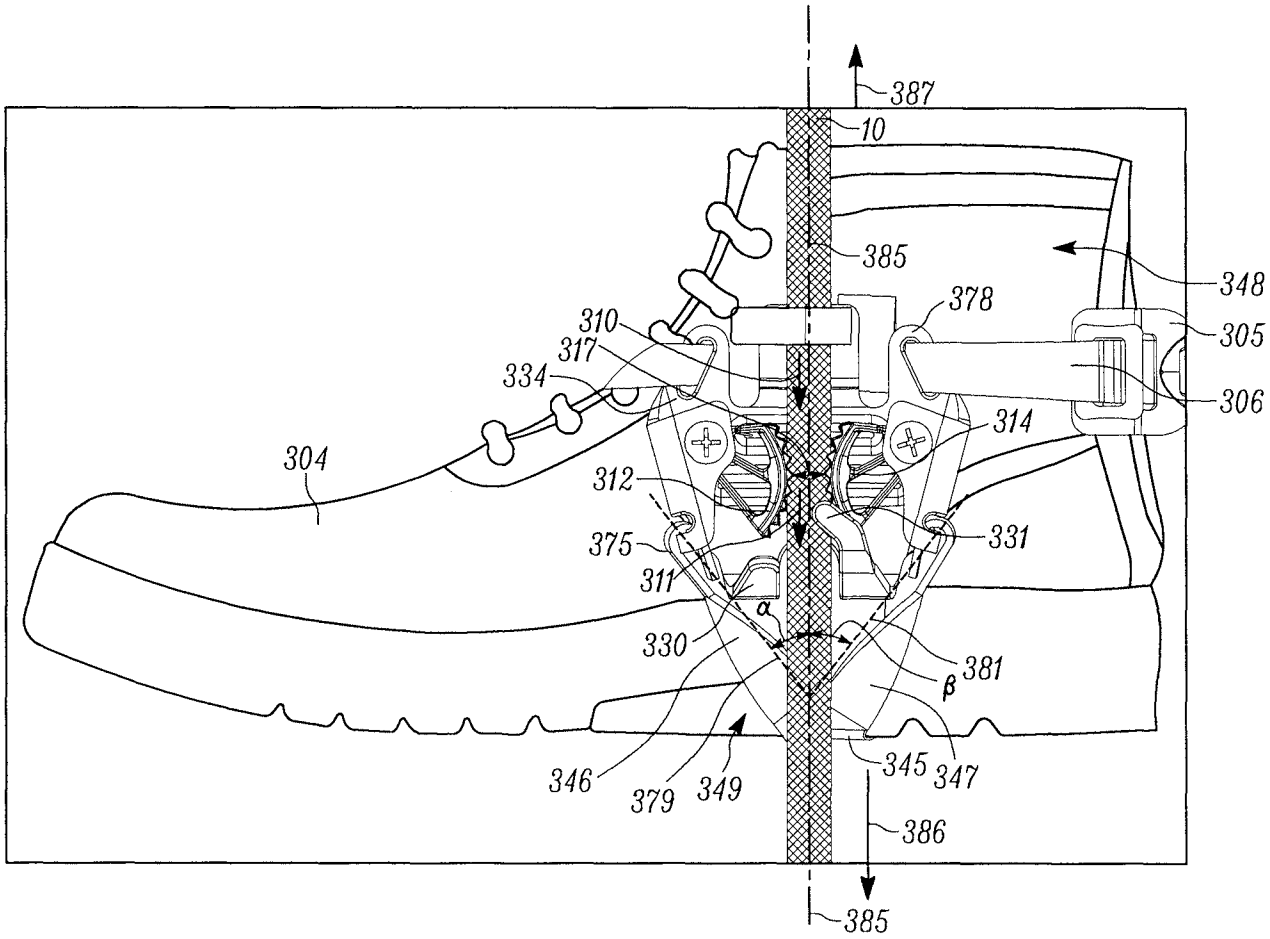
FIG. 24 illustrates a front view of the device shown in FIG. 17 secured to an object, with the rope situated in the device.

As shown in FIG. 24, first bottom strap leg 346 has a first leg axis 379 that is situated at an angle $\alpha$ relative to central vertical axis 385, and second bottom strap leg 347 has a second leg axis 381 that is situated at an angle $\beta$ relative to central vertical axis 385 of device 300. In at least some embodiments angles $\alpha$ and $\beta$ are the same, while in other embodiments they can differ, further in at least some embodiments, they are equal to a value between about 50 degrees and about 15 degrees, while in other embodiments, they are equal to a value of about 40 degrees, while in yet other embodiments, they can be greater than 0 degrees and less than 180 degrees.

During operation, and as noted above, rope 10 moves through the gap 317 in the pawls 312 and 314 similar to devices 100, with the upward biased first and second pawls 312 and 314 locking rope 10 in place when a climber applies a downward force (general downward direction shown by arrow 386 in FIG. 24) on shoe 304, thereby at least partially closing the gap 317, and also releasing the lock when shoe 304 is lifted upward (general upward direction shown by arrow 387 in FIG. 24) to allow rope 10 to pass downward therethrough, from a rope feed inlet portion 310, through the pawls 312, 314, and out a rope feed outlet portion 311 (see FIG. 24). It is noted that the addition of the gates 330, 331, and 377, provides enhanced straight-through guidance of rope 10 as it moves through device 300.

Figure 21:
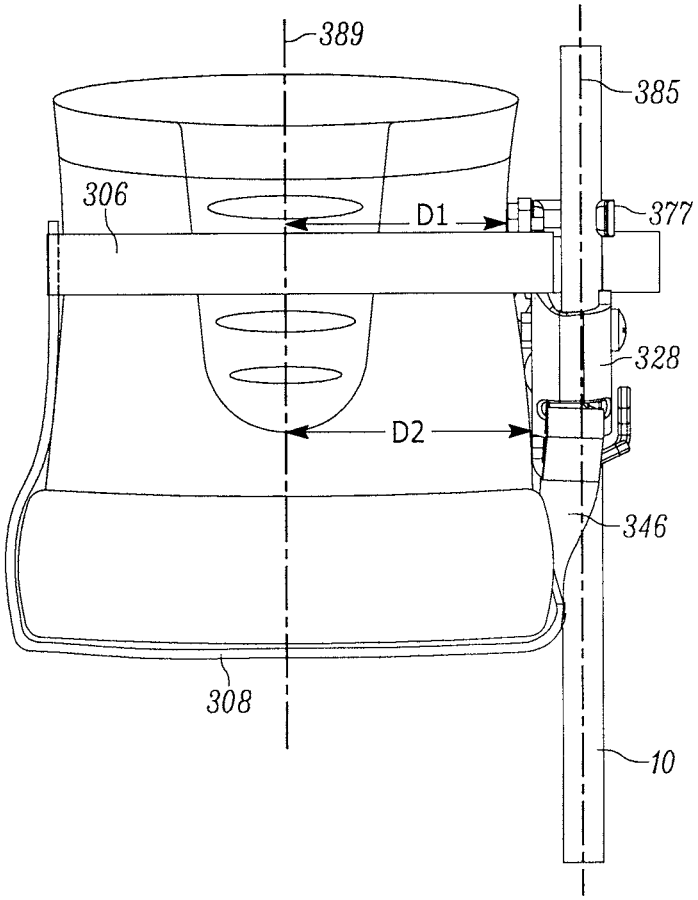
FIG. 21 illustrates a left side view of the device shown in FIG. 17 as secured to a shoe with the rope situated in the device.
Figure 22:
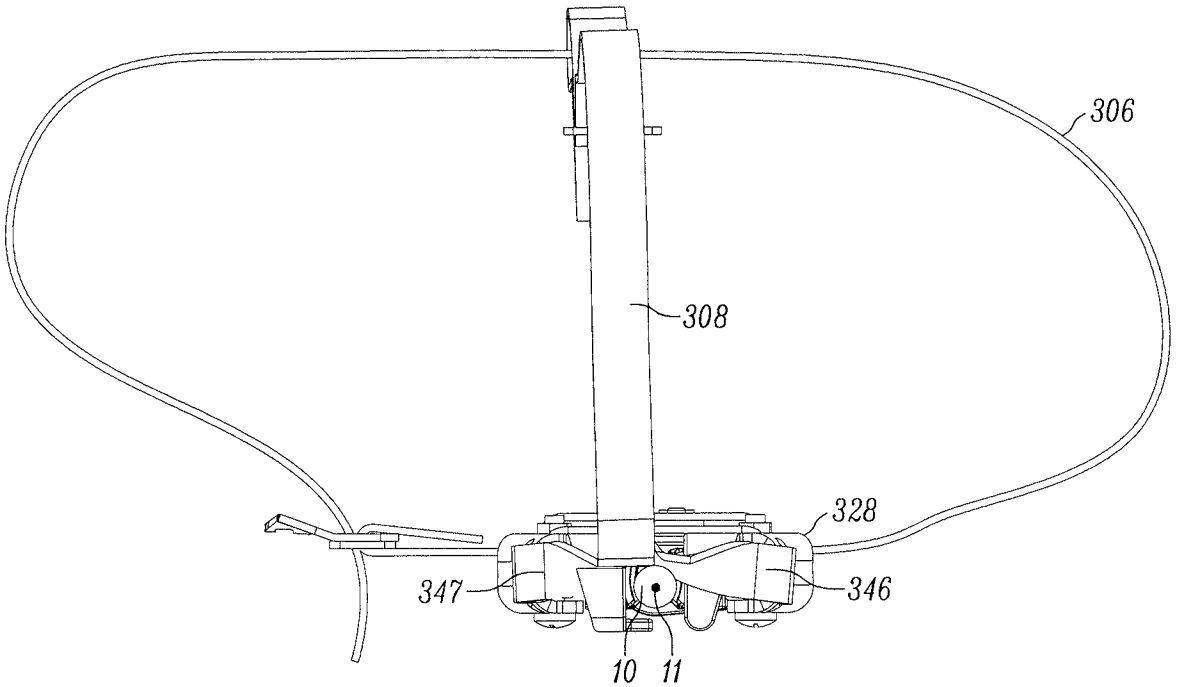
FIG. 22 illustrates a bottom view of the device shown in FIG. 17 with the rope situated in the device.
Figure 23:
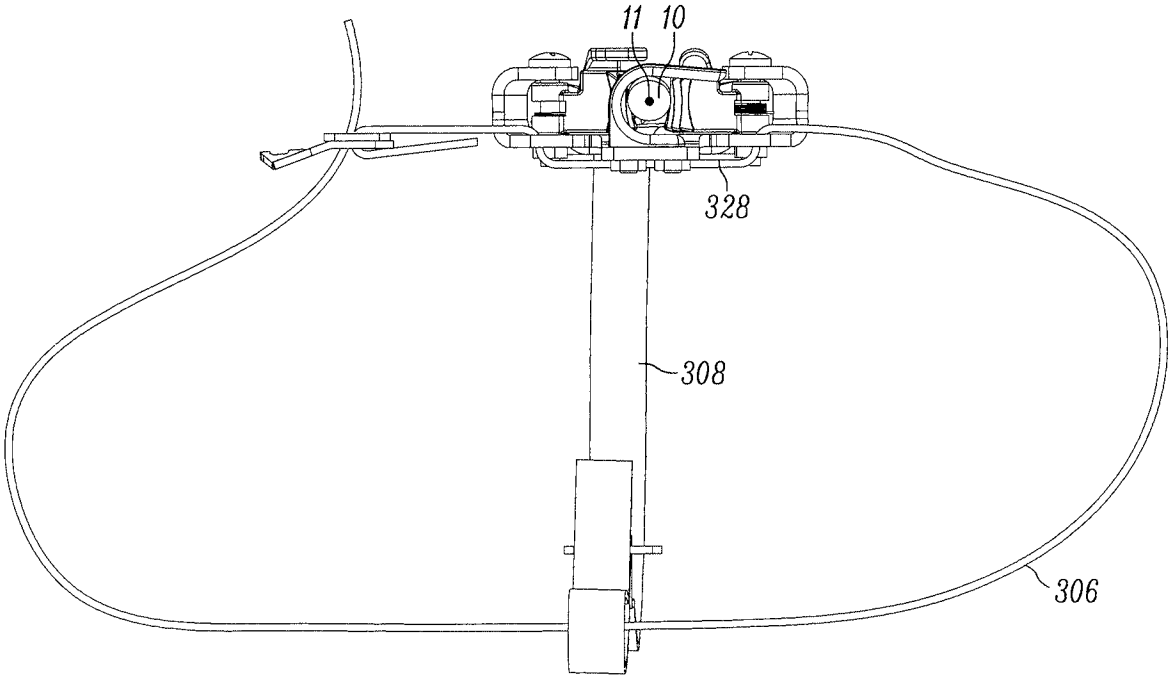
FIG. 23 illustrates a top view of the device shown in FIG. 17 with the rope situated in the device.

The force exerted on device 300 by the climber's weight, via shoe 304 against the suspended rope 10, is significantly balanced by the bridling of the first bottom strap leg 346 and second bottom strap leg 347, along with the configuration of the pawls 312 and 314, and gates 377, 330, and 331, which position a rope center 11 of rope 10 (see FIGS. 22 and 23) about the central vertical axis 385 of base plate 328. More particularly, the bridled configuration substantially aligns a strap reaction force 403 (see FIG. 16) with rope center 11, wherein the strap reaction force is the downward force imparted onto base plate 328 about bridled portion 345 in response to an upward force 404 (see FIG. 17) of rope 10 acting along central vertical axis 385 of base plate 328 when rope 10 is secured by the pawls 312 and 314. Noting that strap reaction force 403 and upward force 404 may be expressed as vector forces. As a result, side-to-side motion, rotation, and shifting (i.e., racking) of device 300 relative to shoe 304 is substantially limited or prevented. In contrast to various other mechanisms, such as those that utilize both a single centered securement to a bottom portion of an ascension device and an offset rope feed-through mechanism (rope is fed through and secured by one side of the device (i.e., non-symmetrically), racking of device 300 relative to shoe 304 is substantially reduced or prevented. FIG. 21 depicts device 300 mounted to shoe 304.

Figure 16:
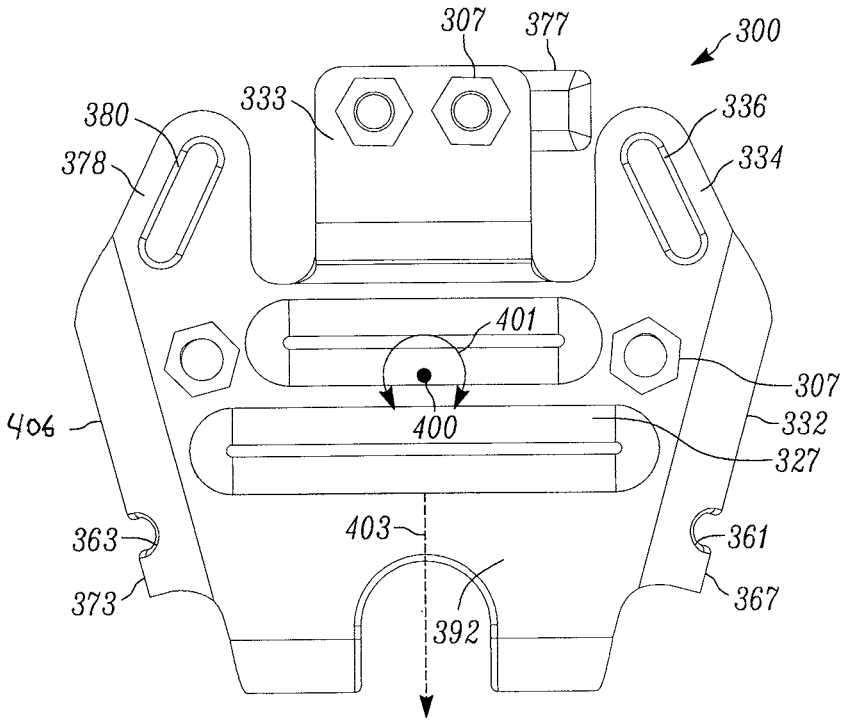
FIG. 16 illustrates a rear view of the device of FIG. 13.
Figure 17:
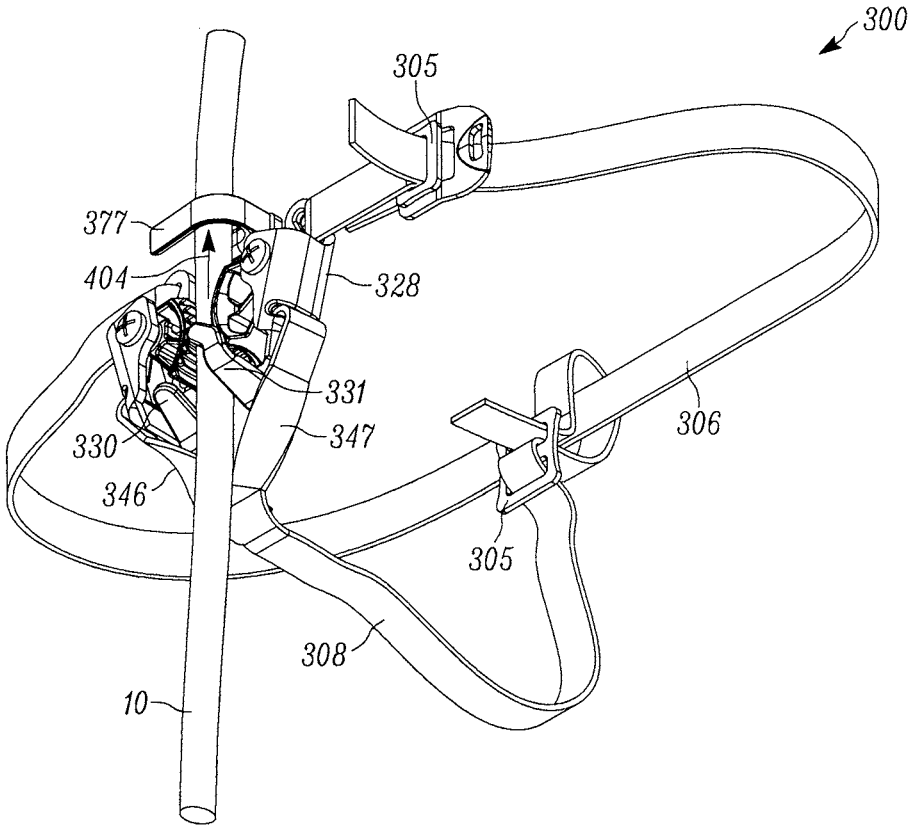
FIG. 17 illustrates a front perspective view of the device of FIG. 13 with device straps installed and a rope situated in the device.
Figure 18:
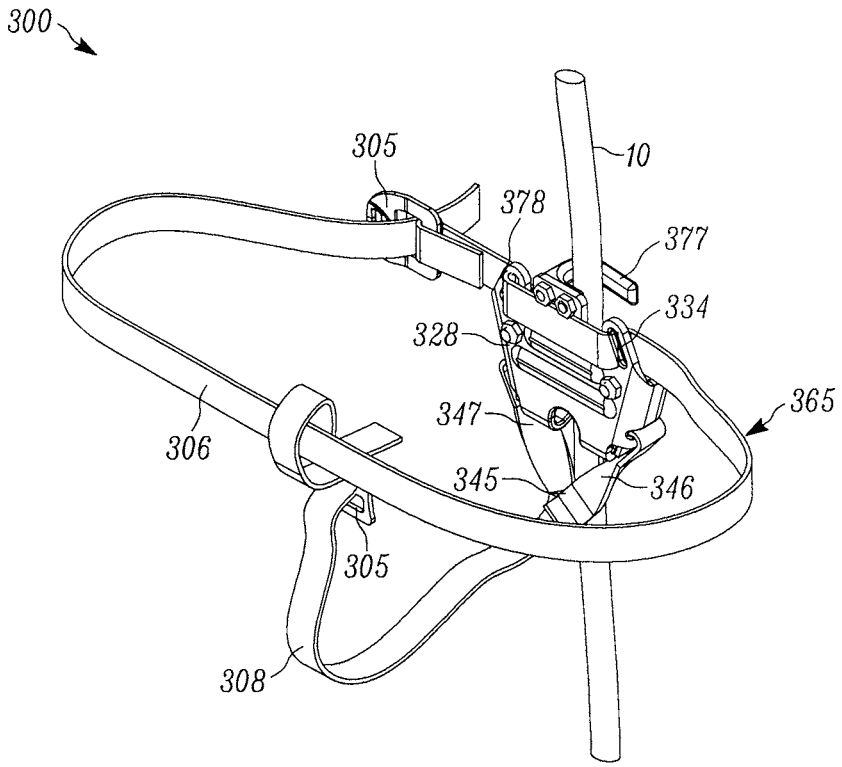
FIG. 18 illustrates a rear perspective view of the device of FIG. 17 with device straps installed and the rope situated in the device.
Figure 19:
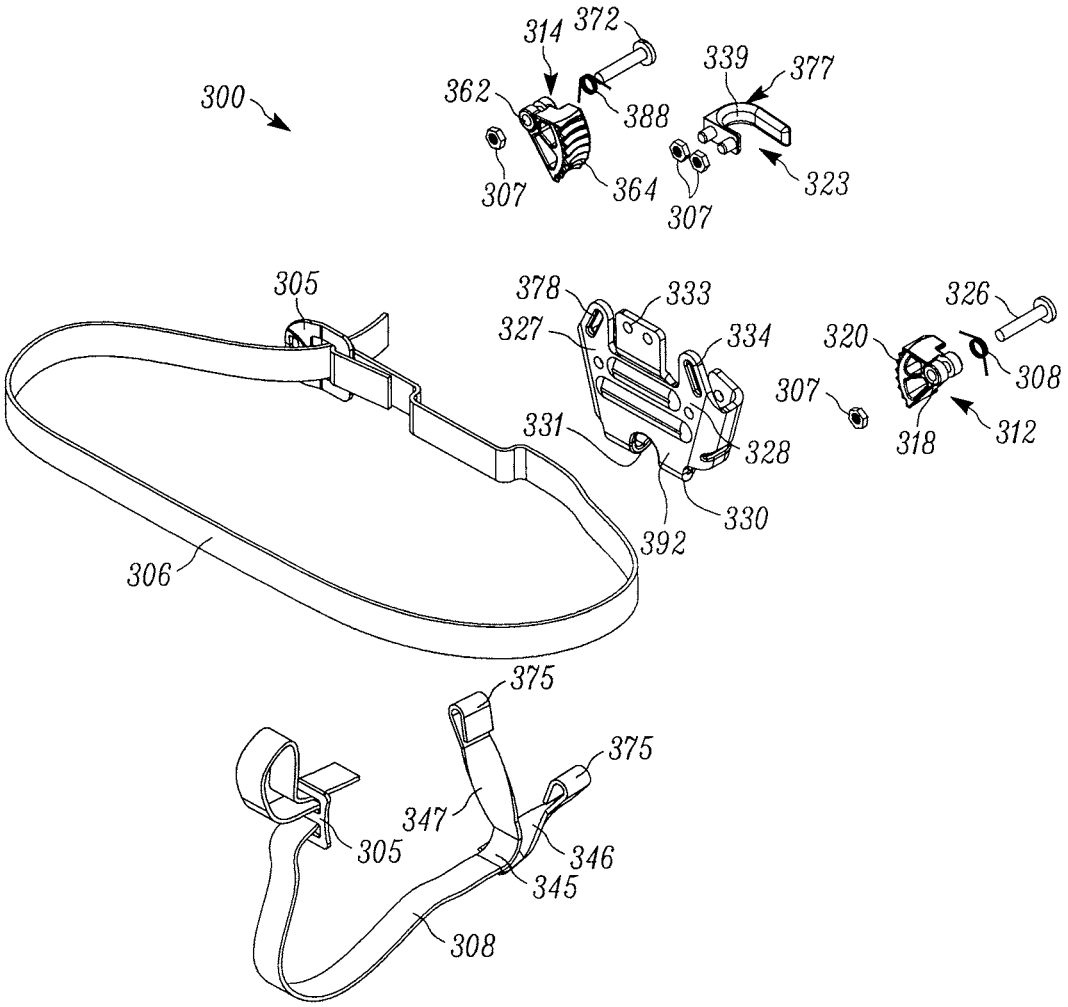
FIG. 19 illustrates an exploded rear perspective view of the device of FIG. 17.
Figure 20:
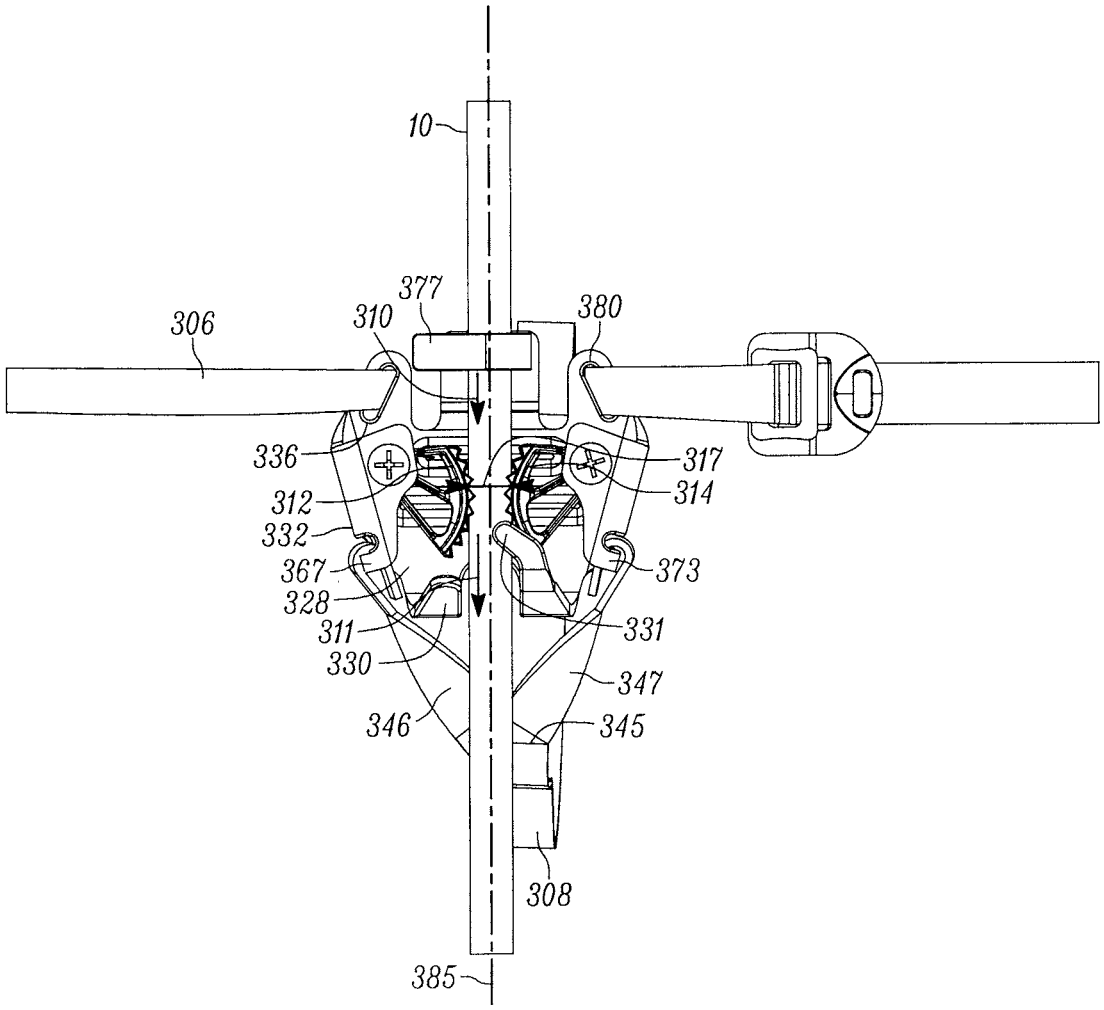
FIG. 20 illustrates a front view of the device shown in FIG. 17 with the rope situated in the device.

When device 300 is installed, the central vertical axis 385 can be substantially parallel to a central shoe axis 389 extending vertically through the shoe 304 where the bottom strap 308 engages the shoe 304. D1 defines the distance between central shoe axis 389 and the base rear surface 327 at the base top 333, while D2 defines the distance between the axis 389 and the base rear surface 327 at the base bottom 392. During loading by user, the bridled configuration of the first bottom strap leg 346 and second bottom strap leg 347, which provides a rotation of the strap as it extends from the lower strap supports and under the shoe 304, balances the load on the device 300 to keep the central vertical axis 385 substantially parallel with central shoe axis 389. This in turn serves to keep D1 and D2 substantially equal in length, thereby preventing or substantially preventing horizontal tipping of device 300 into the shoe 304 at the base top 333 (a reduction in D1) and away from the base bottom 392 (an increase in D2). Such horizontal axis racking into the shoe causes extreme discomfort to the user. Further, racking of an ascension device in general can notably limit an ascender's ability to properly feed a rope through while climbing and causes the ascension device to work loose from securement on a shoe preventing engagement and disengagement maneuvers, inconveniencing and endangering the climber. Ascender devices that lack the bridled configuration, suffer from the support straps extending from the device to the shoe flatly and without rotation (no twist), which can cause substantial horizontal axis racking during use. In addition to horizontal axis racking, vertical axis racking can also occur when the device 300 rotates about a central through axis 400 (approximate location) as shown in FIG. 16, in either a clockwise or counter-clockwise direction as shown by circular arrows 401. The spaced positioning of upper strap supports 334 and 378, and lower strap supports 367 and 373, along with the bridled lower strap 308 serve to balance the forces to prevent or substantially prevent vertical rotation.

It is to be noted that device 300 is ambidextrous, wherein the upper gate 377 can be, but does not have to be, rotated so that the opening 323 faces the toe of the shoe 304 for one of the shoes. The ascender device and method of use can include numerous embodiments. It is specifically intended that the ascender device and method of use are not to be limited to the embodiments and illustrations contained herein, but include modified forms of those embodiments including portions of the embodiments and combinations of elements of different embodiments as come within the scope of the following claims. It is to be understood that the term plurality can include one or more. Further, any steps described herein with reference to a method of use, are not to be considered limiting and can include variations, such as additional steps, removed steps, and re-ordered steps.

I claim:

1. An ascender device configured to secure to an object and to receive and engage a rope comprising:

a base plate having a base top, a base bottom, a base rear surface and a base front surface, wherein the base front surface further includes a first side and a second side;

a first pawl having a first pawl engagement portion, wherein the first pawl is pivotably secured to the base plate on the first side;

a second pawl having a second pawl engagement portion, wherein the second pawl is pivotably secured to the base plate on the second side;

a first biasing element pivotably biasing the first pawl in a counter-clockwise direction towards the base top;

a second biasing element pivotably biasing the second pawl in a clockwise direction towards the base top;

a plurality of first teeth situated along the first pawl engagement portion and second teeth situated along the second pawl engagement portion, wherein the first and second teeth are at least in part, opposed to each other to form a gap that extends between the teeth and the gap is configured to receive a rope therein;

a plurality of upper strap supports extending from the base, including a first upper strap support situated on the first side and a second upper strap support situated on the second side;

a plurality of lower strap supports extending from the base, including a first lower strap support situated on the first side and a second lower strap support situated on the second side;

an upper gate extending from the base top having an opening for receiving the rope therein;

a plurality of lower gates extending from the base bottom to receive the rope therebetween; and a securement device for securement to an object, having a side strap interconnected with the first upper strap support and the second upper strap support, and a bottom strap, with the bottom strap including a bridled portion that couples a first bottom strap leg and a second bottom strap leg, which are secured to respective lower strap supports.

2. The device of claim 1, wherein the lower strap supports are non-planar with the base front surface, and wherein a strap reaction force that includes a downward force imparted onto the base plate by the bridled portion in response to an upward force of the rope when secured by the first and second pawls is substantially aligned with a center of the rope.

3. The device of claim 2, wherein the opening of the upper gate is not closable.

4. The device of claim 1, wherein the plurality of upper strap supports include strap slots for receiving the side strap therethrough.

5. The device of claim 4, wherein lower strap supports include respective slots for coupling with the first bottom strap leg and the second bottom strap leg.

6. The device of claim 5, wherein the first bottom strap leg and a second bottom strap leg are each rotated between about 25 degrees to about 90 degrees as they extend between the bridled portion and the lower strap supports they are respectively secured to.

7. The device of claim 1, wherein a strap reaction force that includes a downward force imparted onto the base plate by the bridled portion in response to an upward force of the rope when secured by the first and second pawls is substantially aligned with a center of the rope.

8. The device of claim 7, wherein a first central vertical axis defined by the upper gate, the plurality of lower gates, the base front surface, and the pawl engagement portions provides a substantially straight rope feed-through path for receiving the rope therethrough.

9. The device of claim 8, wherein the object to which securement of the securement device is performed includes a second central vertical axis extending therethrough that extends parallel to the first central vertical axis when engaged to the rope and during application of a downward force on the object.

10. The device of claim 9, wherein upon insertion of the rope into the rope feed-through path and the application of the downward force by the object, the rope is secured in place between the first and second teeth, and the first and second central vertical axes remain substantially parallel.

11. The device of claim 7, wherein the object is an article of footwear and the teeth include a curved edge.

12. The device of claim 11, wherein the rope can be inserted into and removed from the upper gate, the gap, and the lower gates without feeding a terminal end of the rope therethrough.

13. An ascender device configured for securement to an article of footwear for engagement with a rope comprising:

a base plate having a base top, a base bottom, a base rear surface, and a base front surface, wherein the base front surface further includes a first side and a second side;

a first pawl pivotably secured to the base plate on the first side;

a second pawl pivotably secured to the base plate on the second side;

at least one biasing element for pivotably biasing the first pawl counter-clockwise towards the base top and the second pawl clockwise towards the base top;

a plurality of first teeth on the first pawl and second teeth on the second pawl, wherein the first and second teeth are at least in part, opposed to each other to form a gap that extends between the teeth and wherein the gap is configured to receive a rope therein and can be increased and decreased in size via pivoting of the first and second pawls to releasably engage the rope;

a plurality of upper strap supports extending from the base;

a plurality of lower strap supports extending from the base;

an upper gate adjacent the base top and having an opening for receiving the rope therein;

a plurality of lower gates extending from the base bottom to receive the rope; and a securement device for securement to an article of footwear, having a side strap interconnected with the plurality of upper strap supports, and a bottom strap interconnected with the plurality of lower strap supports, wherein a first central vertical axis defined by the upper gate, plurality of lower gates base plate and the gap provides a substantially straight rope feed-through path for receiving the rope therethrough and wherein the rope feed-through path maintains the rope in a substantially vertical position as it extends above and below the base plate.

14. The device of claim 13, wherein the plurality of upper strap supports include a first upper strap support situated on the first side and a second upper strap support situated on the second side.

15. The device of claim 14, wherein the plurality of lower strap supports include a first lower strap support situated on the first side and a second lower strap support situated on the second side.

16. The device of claim 15, wherein the bottom strap includes a bridled portion interconnected to the plurality of lower strap supports.

17. The device of claim 15, wherein the bottom strap is planar and includes a bridled portion coupling a first bottom strap leg and a second bottom strap leg, which are secured to respective lower strap supports.

18. The device of claim 17, wherein the first bottom strap leg and a second bottom strap leg are each rotated between about 25 degrees to about 90 degrees as they extend between the bridled portion and the lower strap supports they are respectively secured to.

19. The device of claim 18, wherein the lower strap supports are non-planar with the base front surface, and wherein a strap reaction force that includes a downward force imparted onto the base plate by the bridled portion in response to an upward force of the rope when secured by the first and second pawls is substantially aligned with a center of the rope.

* * * * *